United States Patent [19]

Ferneau

[11] 4,405,172

[45] Sep. 20, 1983

[54] HIGH DECK AMBULANCE CART

[75] Inventor: Richard H. Ferneau, Washington Court House, Ohio

[73] Assignee: Marianne Adler, San Diego, Calif.

[21] Appl. No.: 313,375

[22] Filed: Oct. 21, 1981

[51] Int. Cl.[3] ..... A61G 1/02

[52] U.S. Cl. ..... 296/20; 5/86

[58] Field of Search ..... 296/20; 5/86, 81 R, 5/81 B, 82 R; 280/43.1

[56] References Cited

U.S. PATENT DOCUMENTS

| | | | |
|---|---|---|---|
| 3,826,528 | 7/1974 | East | 296/20 |
| 3,980,334 | 9/1976 | Ferneau et al. | 296/20 |
| 4,052,097 | 10/1977 | Neil et al. | 296/20 |

*Primary Examiner*—Richard A. Bertsch

*Attorney, Agent, or Firm*—Wood, Herron & Evans

[57] ABSTRACT

A high deck multi-level ambulance cart. An upper frame forming a bed is supported above a lower frame, having wheels, by forward and rearward legs. The upper frame supports a longitudinal beam. The upper ends of the legs are slidably mounted on the beam and have multiple positions along the beam secured by releasable stops. By sliding the upper ends of the legs to selected positions, the upper frame can assume the following positions:

(a) a transport position in which the frame is horizontal and legs are generally vertical;

(b) a loading position in which the frame is shifted to an upwardly-inclined position by sliding the forward legs in a forward directon;

(c) an intermediate position in which the upper frame is lowered to a horizontal position, below its transport position, by sliding the upper ends of the legs in a rearward direction while swinging the lower ends of the legs forward;

(d) an in-car position with the legs swung rearwardly to lie against the upper frame.

13 Claims, 13 Drawing Figures

HIGH DECK AMBULANCE CART

This invention relates to an ambulance cart, and more particularly, to a cart suitable for use with high deck ambulances, the cart having a raised transport position, a lowered intermediate position, and a fully collapsed in-car position with the legs swung rearwardly to lie against the upper frame of the cart.

Prior to the invention of Weil in the mid 1950's in mortuary and ambulance work, a body was picked up on two-man stretchers and somewhat awkwardly shifted into an ambulance. Following the inventions of Weil as represented by his U.S. Pat. Nos. 2,841,438, 2,877,047 and 2,877,048, the transportation of bodies from the home to the hospital or mortuary was greatly facilitated. The initial Weil concept involves a cart having a bed frame supported on depending legs which was pivotally mounted to the bed frame. Auxiliary or entry wheels are mounted at the forward end of the bed frame. With that structure the cart can be fully collapsed to pick up the patient by swinging the legs rearwardly, the bed frame can be raised and supported on the legs as the patient is rolled to the ambulance. At the ambulance, one man standing at the rear of the cart can roll the entry wheels onto the deck of the ambulance to provide support for the forward end of the cart. Continuing to roll the cart forward, the operator releases the bracing for the legs so that the legs can be swung rearwardly by the engagement of the front of the legs with the ambulance bumper until the legs are fully collapsed to lie against the frame as the cart is thrust completely into the ambulance.

One of the subsequent developments, as represented by U.S. Pat. No. 3,826,528, created a multi-level cart in which the bed frame is lowered from its transport position to an intermediate or home bed height. The cart can also be fully collapsed to permit the cart to be thrust into an ambulance. The cart of that patent employs a longitudinal beam supported on the bed frame with longitudinal slides connecting the upper ends of the legs to the longitudinal beam. To shift from a transport position down to an intermediate home bed level position, the legs are spread apart. To shift from a transport position to a fully collapsed in-car position, the legs are swung rearwardly in a manner similar to that employed in the original cart.

The cart has presented a problem arising out of the spread-apart position of the legs. When swung apart, the swivel axes for the wheels on the lower end of the cart move from a vertical axis to an inclined axis, and that prevents the wheels from swiveling properly.

The swiveling problem is solved by the invention resulting in U.S. Pat. No. 3,980,334 wherein the legs are provided with a lower telescoping frame which maintains the wheels on a vertical axis as the legs are swung apart to lower the cart to an intermediate position. Repeated use of that cart developed problems, particularly with the telescoping frame binding.

The problems attending the cart of the '334 patent have been solved by the cart of the present invention.

It has been an objective of the present invention to provide a multi-level cart, preferably with a high deck loading position, in which the legs can be swung rearwardly to a fully in-car position to facilitate the loading of the cart into the ambulance and in which the cart can be shifted to an intermediate position without requiring the legs to swing apart as in the prior carts.

It has been another objective of the present invention to provide an ambulance cart in which the bed frame can be lowered without requiring the legs to be swung apart while nevertheless maintaining the wheels at the lower ends of the legs substantially centered below the upper frame of the cart so as to maintain the stability of the cart.

These objectives of the invention are attained by providing a cart having an upper bed frame, a rigid lower frame, and forward and rearward, generally vertical, legs connecting the upper frame to the lower frame. The upper ends of the legs are connected to the upper frame by means of slides so as to permit the legs to swing to the rear for loading the cart into an ambulance and to permit the legs to swing forwardly while the slides carry the upper portions of the legs in a rearward direction as the upper frame is lowered to an intermediate position. The combined action of sliding the upper ends of the legs rearwardly while swinging the legs forwardly tends to maintain the lower frame, with the wheels which it carries, in a generally centered position with respect to the upper frame.

Several additional features are found in the present invention. The cart is adapted to assume a loading position by sliding the upper ends of the forward legs in a forward direction which raises the front end of the cart to bring the entry wheels carried at the forward end of the bed frame up to the level of the deck of a high deck ambulance.

The rigid frame always maintains the axes of the swivel wheels in a vertical attitude so that the patient can be wheeled from place to place in either the transport position or the lowered intermediate position.

The legs are adapted to swing rearwardly in unison to permit the cart to be thrust into an ambulance with the entry wheels rolling on the deck of the ambulance while an operator supports the cart from the rear of the cart.

Cooperating abutments on the upper ends of the legs and frame, respectively, permit the upper ends of the legs to be releasably locked in selected positions corresponding to the several positions of the cart. These abutments preferably are in the form of a longitudinal beam upon which the slides ride, stops in the longitudinal beam and spring-loaded pins on the upper ends of the legs adapted to engage the stops.

A mechanism is provided for operating the pins by means of operating levers at each end of the cart. The mechanism is preferably interrelated so as to permit the cart to be shifted from the upper transport position to the lowered intermediate position only upon manipulation of the operating levers by a person standing at each end of the cart.

The invention further provides a springs adapted to urge the upper ends of the legs to slide to the desired positions when the weight is shifted from the legs by the operator's lifting up on the upper frame.

The rear legs are preferably in a vertical attitude when the cart is in its transport position and the forward legs are preferably rearwardly inclined when in that position. This permits the forward end of the cart to be raised when the forward legs are swung to a more vertical attitude.

The upper ends of the legs are interconnected so that when the cart is to be lowered to an intermediate position, the upper ends of the forward legs will immediately start to slide in a rearward direction when the necessary abutment is released and weight is applied to the forward end of the cart. That rearward movement will force the upper ends of the rearward legs to slide in a rearward direction past the vertical position so that weight upon them will force them to slide to the intermediate position. That interconnection is provided with a lost motion feature which enables the forward legs to move in a forward direction without moving the rearward legs when the cart is to be shifted to the upwardly inclined loading position.

The several objectives and features of the present invention will become more readily apparent from the following detailed description taken in conjunction with the accompanying drawings in which.

Figure 1:
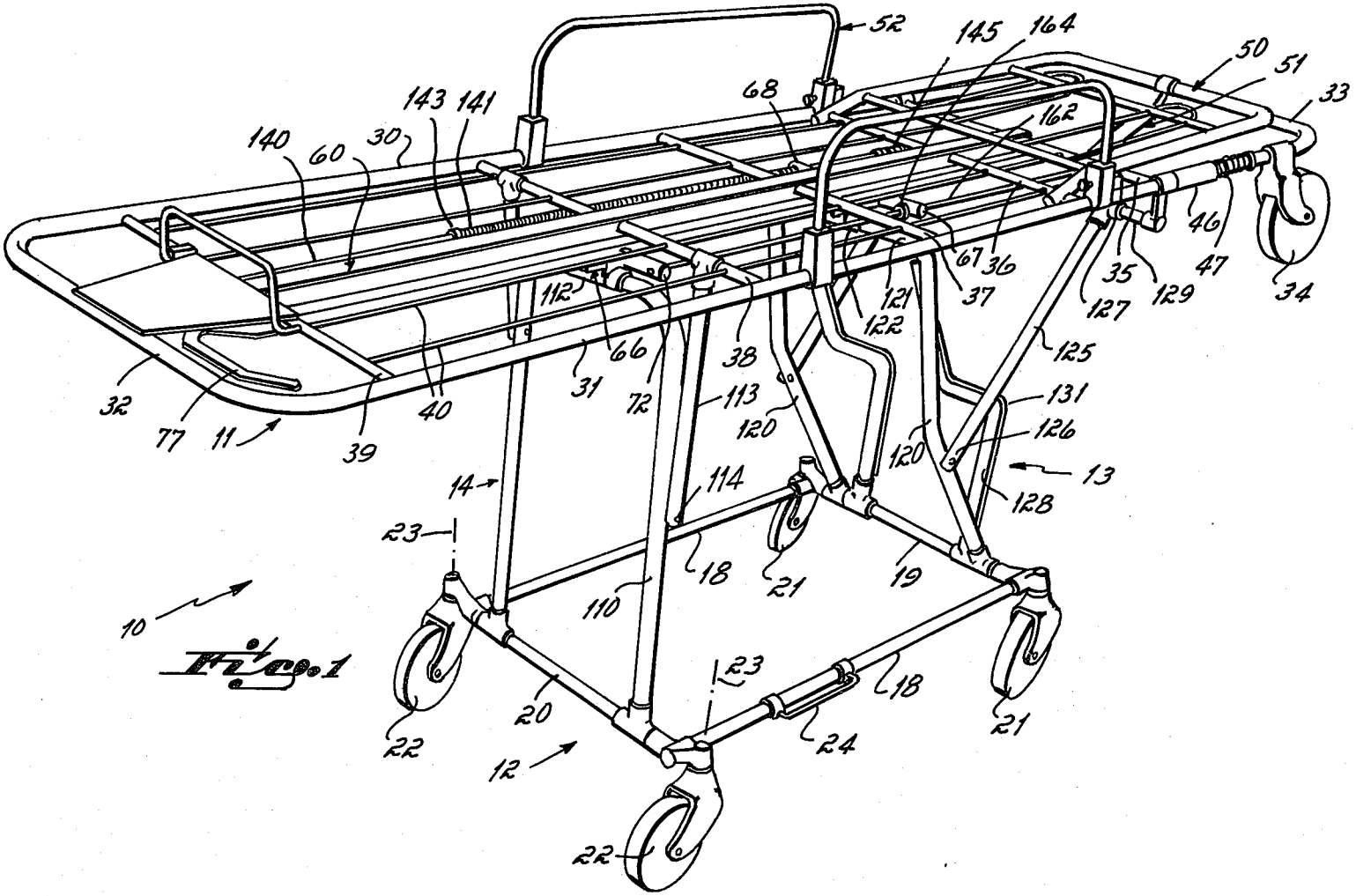
FIG. 1 is a perspective view of the cart of the present invention.
Figure 2:
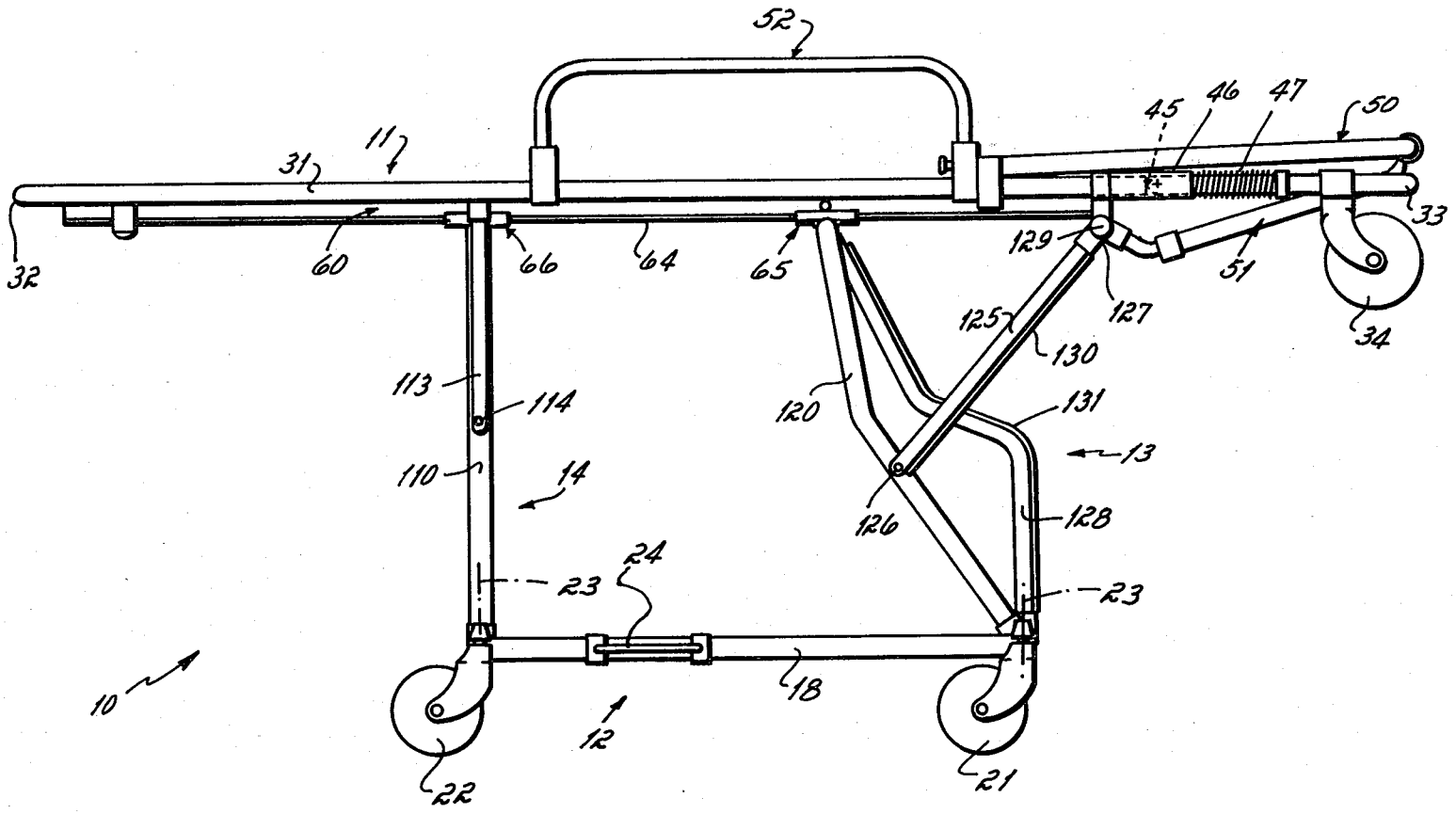
FIG. 2 is a side elevational view thereof.
Figure 3:
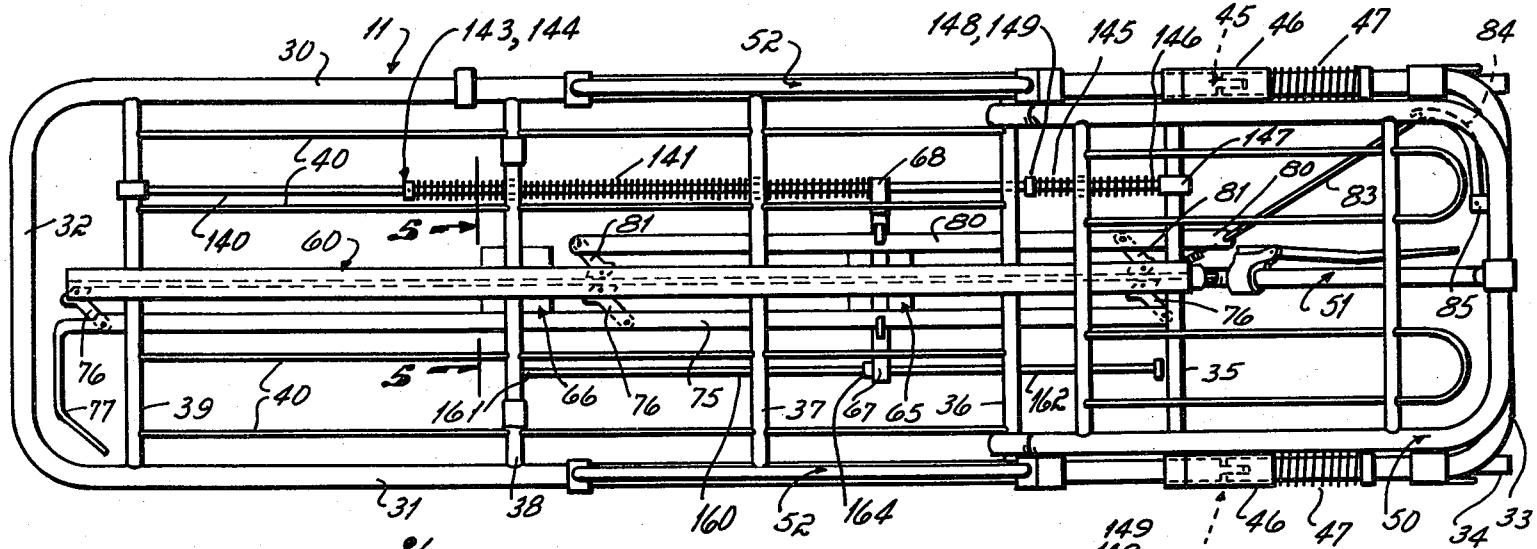
Figure 2A:
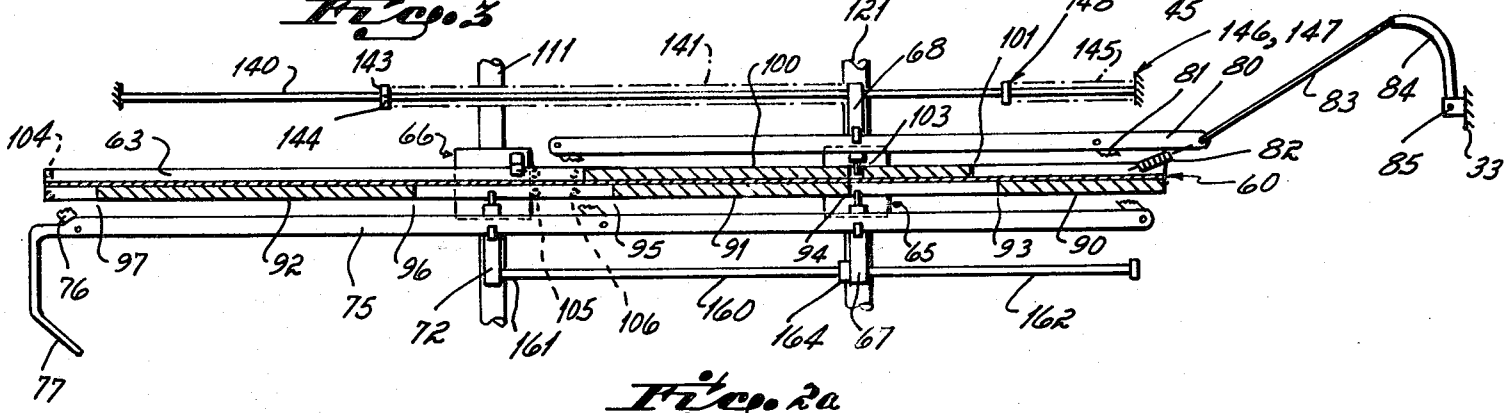
Figure 4:
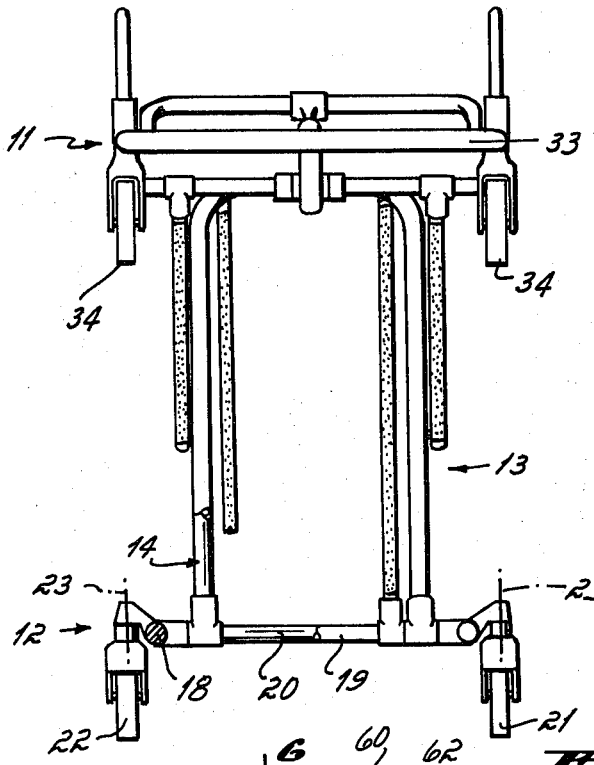

FIG. 2*a* is a diagrammatic longitudinal cross-section view illustrating the latch structure, the latches being in the transport position;

FIG. 3 is a top plan view thereof;

FIG. 4 is an end elevational view taken from the front end of the cart with portions of the cart broken away for clarity, etc.

Figure 5:
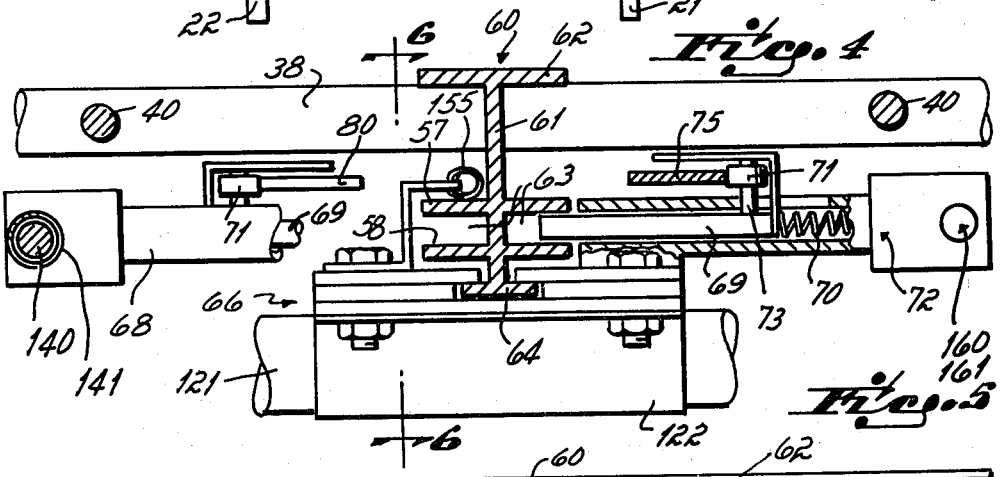
Figure 6:
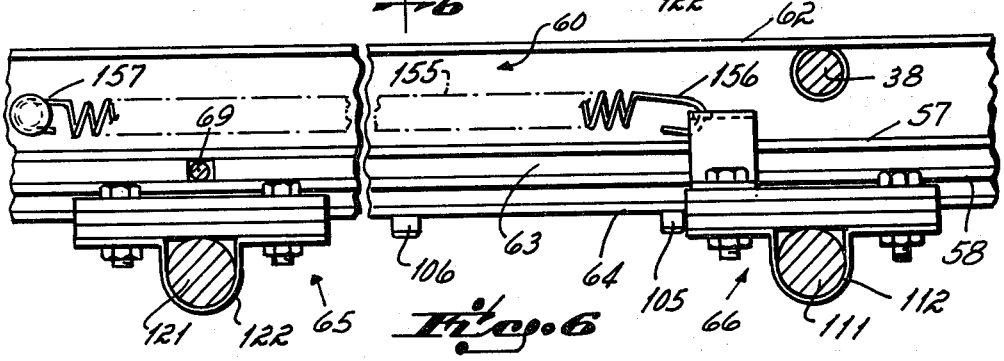
Figure 7A:
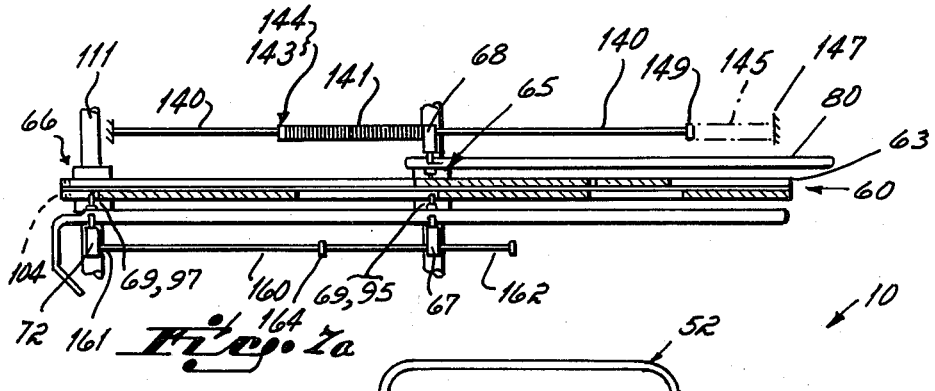
Figure 7:
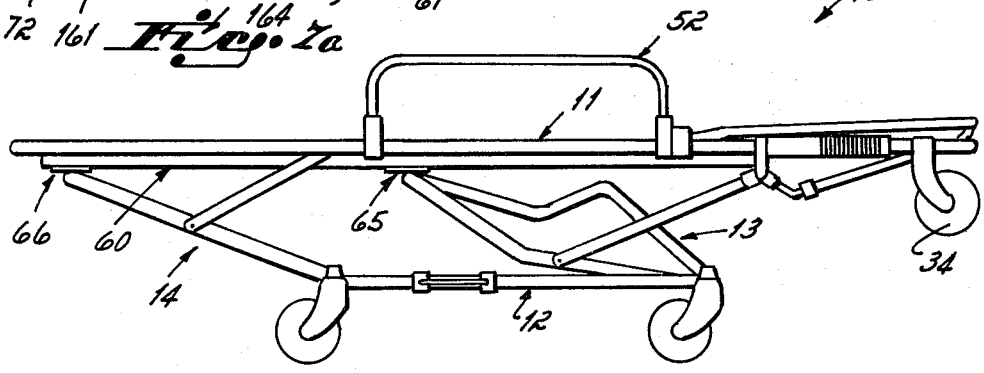
Figure 8A:
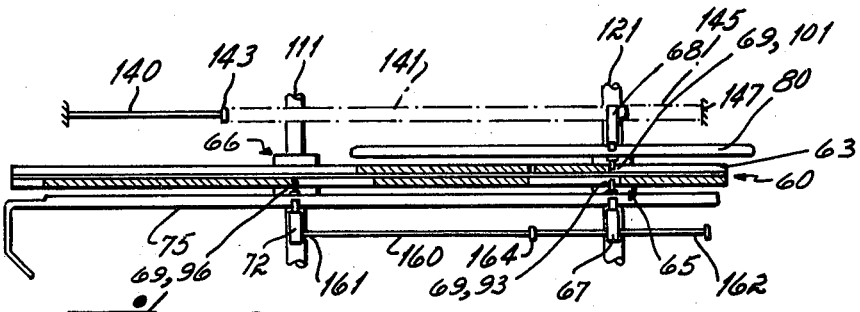
Figure 8:
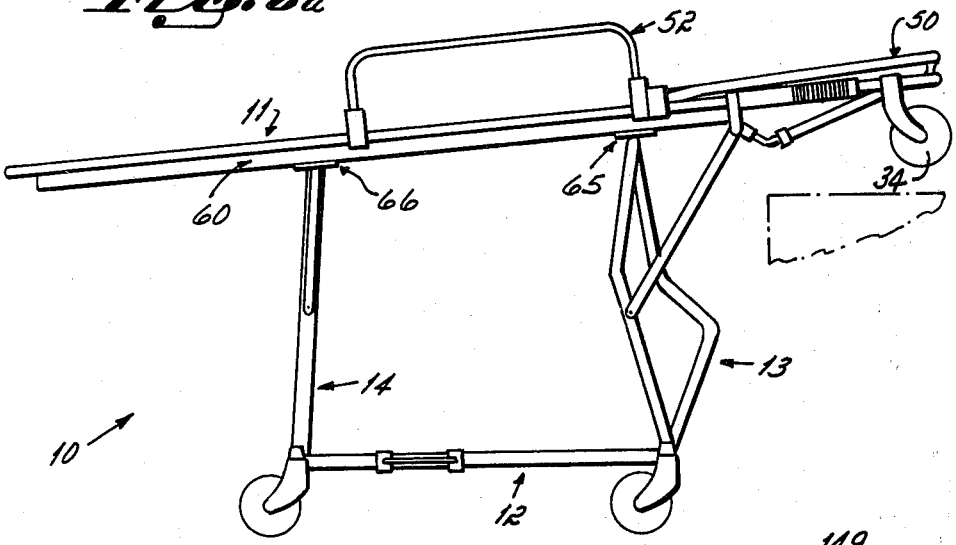
Figure 9A:
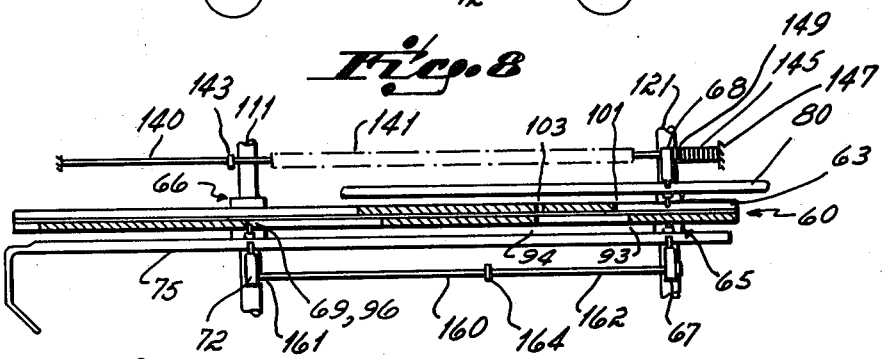
Figure 9:
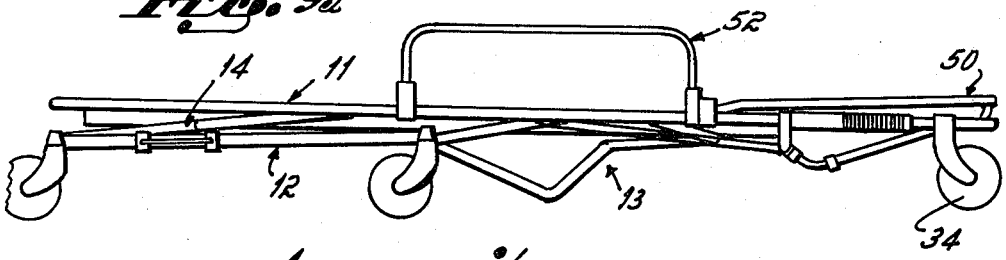

FIG. 5 is a cross-sectional view through the slide as seen on line 5—5 of FIG. 3;

FIG. 6 is a cross-sectional view taken on line 6—6 of FIG. 5;

FIG. 7 is a diagrammatic side view of the cart in an intermediate position;

FIG. 7*a* is a view similar to FIG. 2*a* except that the latches are in an intermediate position;

FIG. 8 is a diagrammatic side view of the cart in a loading position;

FIG. 8*a* is a view similar to FIG. 2*a* except that the latches are in a loading position;

FIG. 9 is a diagrammatic side view of the cart in an "in-car" position; and

FIG. 9*a* is a view similar to FIG. 2*a* except that the latches are in an "in-car" position.

THE LOWER FRAME

Referring to FIGS. 1 to 4, the cart 10 includes an upper frame 11 and a lower frame 12. Generally vertical forward legs 13 and vertical rearward legs 14 connect the upper bed frame to the lower frame.

The lower frame 12 includes two longitudinal bars 18 and two transverse bars 19, 20 fixed to the forward and rearward ends of the longitudinal bars 18, respectively. Forward and rearward wheels 21 and 22 are mounted to the frame on vertical swivel axes 23. One of the longitudinal bars 18 is preferably provided with a handle 24 to assist in the rearward swinging of the legs when the cart is thrust into an ambulance.

THE UPPER FRAME

The upper frame 11 has two longitudinal bars 30 and 31 which are connected at the rearward end by a transverse bar 32 and at the forward end by a transverse bar 33. Auxiliary or entry wheels 34 are mounted on the forward ends of the longitudinal bars 30 and 31. The longitudinal bars are also connected by intermediate transverse bars 35, 36, 37, 38 and 39. Inboard longitudinal bars 40 interconnect the transverse bars 36–39 to form a mattress-supporting structure.

The forward ends of the longitudinal bars 30, 31 are hinged as at 45 so that the forward end of the frame can be swung downwardly to shorten the overall length of the cart to facilitate turning in tight corners, getting into small elevators and the like. Sleeves 46 are urged by compression springs 47 to slide over the hinges, thereby normally maintaining the front portion of the cart in alignment with the rear portion.

A brackrest 50 is pivotally mounted to the transverse bar 36 and is provided with a brace 51 which permits it to be swung in an upwardly inclined position to support the upper portion of a pateint's body in a raised position.

Guard rails 52 are provided at each side of the bed frame, the guard rails being pivotally mounted on the longitudinal rails 31, 32 so that they can be dropped to an inoperative position which permits the patient to be loaded easily onto the cart.

THE SLIDE MECHANISM

A longitudinal beam 60, preferably an extrusion having a cross-sectional configuration shown in FIG. 5 is supported in the center of the bed frame. The beam includes a vertical web 61 through which the transverse bars 35–39 pass. The beam also includes an upper flange 62, intermediate flanges 57 and 58 which define an intermediate channel 63 and a longitudinal flange or track 64 at the bottom of the beam. Referring to FIGS. 3 and 5 a forward slide 65 and a rearward slide 66 are slidably mounted on the track 64 of the longitudinal beam 60. The forward slide carries two laterally-projecting tubes 67, 68 projecting from each side. Similarly, the rear slide carries a laterally-projecting tube 72 which projects to the same side as the tube 67. As shown in FIG. 5, each tube carries a pin 69 slidable in the tube which is urged by a compression spring 70 toward the beam 60. Each tube is slotted on its upper surface to permit a lug 73 to project outside of the tube. This lug is connected at its inner end to the pin 69 and carries a roller 71 on its free end.

A longitudinal release bar 75 is mounted on the right side of the beam (when facing from the rear toward the front of the cart). The bar is supported by three arms 76 which are pivoted to the bar 75 and flange 57, respectively. The release bar 75 has a handle 77 at its rearward end. When the bar is pulled rearwardly, the arms 76 cause the release bar to swing laterally with respect to the beam 60 thus bearing against the rollers 71 so as to slide the pins 69 away from the beam 60, releasing them from the stops to be described. The springs 70 behind the pins cause the pins to return carrying the release bar 75 with them.

At the left side of the beam 60 is a release bar 80 likewise supported by arms 81 pivoted between the bar and the flange 57 of the beam. A tension spring 82 (FIG. 2*a*) connected between the frame and the forward end of the bar urges the bar to its inoperative position close to the beam 60. A rod 83 connects the forward end of the release bar to a handle 84 pivoted at 85 to the transverse frame bar 33. When the handle 84 is pulled, it acts through the rod 83 to move the release bar 80 in a forward direction. In moving in a forward direction, the release bar swings about the arms 81 to cause it to move laterally away from the beam and to urge the pin 69 of the tube 68 out of engagement with its stop.

As best seen in FIG. 2*a*, the pins 69 and the respective slides cooperate with a plurality of stops borne by bars and set screws mounted in the channel 63 and depending from the track 64, thereby creating abutments which maintain the cart in its several positions against the weight of the cart and the patient on the cart. On the right side of the beam 60 (the side with front and rear tubes 67, 72) are bars 90, 91 and 92 providing at their ends, stops 93, 94, 95, 96 and 97. At the left side of the beam is a bar 100 providing a stop 101 and a stop slot 103. At the rear end of the beam 60 a pair of set screws 104 provide a stop for the rearward movement of the rear slide 66. Set screws 105 provide stops for the slide 66 at the forward end of its travel. Set screw stops 106 provide stops for the forward slide 65 at the rearward end of its travel to the intermediate position. The stop 97 on the bar 92 provides a stop for the rearward slide 66 at the rearward end of its travel, preventing it from moving forward, until released, while the cart is in the intermediate positon.

THE LEG STRUCTURE

The rear legs 14 are formed of vertical elements 110 joined at the top by a transverse element 111. The transverse element is journalled to the rear slide 66 at 112 so that the rear leg can pivot with respect to the slide. A brace 113 is pivoted at 114 to the center portion of each vertical element 110 and is journalled to the transverse bar 38 so that the brace can pivot with respect to the transverse bar. The rear leg is normally in the vertical attitude shown in FIGS. 1 and 2 when the cart is in the transport position of FIGS. 1 and 2.

The forward leg 13 has two rearwardly-inclined elements 120 and a transverse element 121 which is journalled at 122 in the forward slide 65 so that the rear legs can pivot with respect to the forward slide 65. An inclined brace 125 is pivoted at 126 to approximately the center portion of each inclined element 120 and is journalled at 127 at its upper end to transverse bar 129 located immediately below the transverse bar 35 so that it can pivot with respect to it. A pair of bumpers 128 are rigidly secured to the transverse section 121 of leg elements 120. These bumpers are journalled at their lower ends to the transverse bar 19 and thus form a part of the forward legs 13. The bumper elements 128 as well as the braces 125 preferably have on their forward surfaces Nylon pads 130 and 131 which protect them as well as the rear surfaces of the ambulance as the cart is moved into and out of the ambulance.

THE SPRINGS AND INTERCONNECTION RODS

Referring particularly to FIG. 3, a longitudinal rod 140 is mounted on the left side of the cart. The tube 68 projecting from slide 65 is slidable on the rod 140. A compression spring 141 is mounted on the rod 140 and has one end engaging the tube 68 and the other end engaging a stop ring 143 fixed by a set screw 144 to the rod 140. The compression spring 141 urges the slide 65 in a forward direction so that when the upper frame is raised from an intermediate position to the transport position the spring thrusts the slide forward from the position shown in FIGS. 7 and 7*a* to the position shown in FIGS. 2 and 2*a*.

Also mounted on the rod 140 is a compression spring 145 having one end 146 bearing against a lug 147 fixed to the transverse bar 35. The other end 148 of the spring 145 bears against a slidable stop ring 149.

When the cart is collapsed to the in-car position (FIGS. 9 and 9*a*), the upper end of the legs 13 slide forward. The tube 68 on the forward slide 65 engages the stop ring 149 and pushes it forward to compress the spring 145. When the cart is thereafter rolled out of the ambulance with the legs dropping to a generally vertical attitude, the compression spring 145 thrusts the slide 65 back to the transport position shown in FIGS. 1, 2 and 2*a*.

A tension spring 155 is connected at one end 156 to the rearward slide 66 and at the other end 157 to the beam 60 at the forward portion of the cart (FIG. 6).

When the cart is lowered from the transport port position to the intermediate position (FIGS. 8 and 8*a*), the upper end of the rear legs 14 swings rearwardly stressing the tension spring 155. When the cart is returned to the transport position shown in FIGS. 1, 2 and 2*a*, the tension spring pulls the slide 66 at the upper end of th rear legs into abutting relationship with stops 105 which is the transport position shown in FIGS. 1, 2 and 6.

The upper ends of the forward and rearward legs are interconnected by a rod 160 (FIG. 3). One end 161 of the rod is fixed to the tube 72 projecting from the slide 66. The other end 162 of the rod is slidably mounted in the tube 67 projecting from the slide 65. A stop ring 164 is fixed to the rod 160 adjacent the tube 67.

When shifting the cart from the transport position (FIGS. 1, 2 and 2*a*) to the intermediate position (FIGS. 7 and 7*a*), the forward end of the cart is first lowered causing the forward slide 65 to move in a rearward direction. Slide 65 engages stop ring 164 and forces rod 160 to the rear. Since the rod 160 is fixed to the rear slide 66, it forces the rear slide in a rearward direction and swings the rear legs from the vertical position to an over-center position where the weight of the cart and the patient cause the rear legs to swing fully to the intermediate position. The tube 67 is slidable with respect to the rod 160 in the forward direction in order to permit the slide 65 to move in a forward direction, independently of the rear legs, as is required when the cart is shifted to the loading position by raising the front end of the frame 11.

OPERATION

Description of the operation of the cart will be assisted by reference to FIGS. 2, 2*a*, and 7 through 9*a*. To begin the description of the operation, let it be assumed that the cart is originally in the transport position. In the transport position (FIGS. 2, 2*a*), the pins 69 projecting from tubes 67 and 68, respectively, are in engagement with the stops 94 and 103, respectively. This engagement holds the front legs in the transport attitude depicted in FIGS. 1 and 2. At the rear legs, the slide is held in engagement with the set screws 105 by spring 155. Additionally, the engagement of the stop ring 164 with the tube 67 will block forward movement of the upper part of the rear legs.

Assuming that it is time to pick up a patient, it will be desired to shift the cart to the lower intermediate position (FIGS. 7, 7*a*) which is at about home bed height or about 21 inches from ground level. This movement requires two persons—one at each end of the cart. The person at the front of the cart pulls lever 84 first to release the pin 69 from the stop 103. This will permit the slide 65 to move in a rearward direction carrying with it the upper end of the legs 13.

As the slide 65 moves in a rearward direction, it drives the rod 160 in a rearward direction which starts the rear movement of the slide 66 on the rear legs. When the person at the rear of the cart pulls the lever 77 to the rear he frees the pin 69 from the stop 94 and the pin 69 from engagement with stop 96.

As the upper end of the rear legs swings past the vertical position, the weight of the cart will cause the cart to drop to the intermediate position. At the intermediate position, the rearward travel of the rear slide will be stopped by the set screw stops 104. The rearward movement of the forward slide 65 will be stopped by the engagement of the set screw stops 106.

It should be observed that when the slides move toward the rear, the wheels 21 and 22 tend to maintain generally the same centered position below the upper frame 11, thereby maintaining the stability of the cart.

In this position, the patient, if ambulatory, can comfortably sit upon the cart and lean back to a reclining position if the backrest has been swung to an upwardly-inclined attitude. If the patient is in bed, he can easily be transferred from the bed to the cart since the cart has been lowered to home bed height. The patient then can be wheeled to the rear of the ambulance after which the cart is raised to the transport position. It is also possible for two persons to carry the cart and patient with the cart in the intermediate position because the legs will not drop down. This may be important when carrying a patient from bed downstairs to the ambulance. When in the intermediate position, the legs cannot drop down because the pin 66 on the rear slide is blocked by its engagement with the stop 97. The forward slide 65 cannot move forward because of the engagement of its pin with the stop 95.

To raise the cart to the transport position, the person at the rear of the cart operates the lever 77 to withdraw the pins from their respective stops 97 and 95, thereby permitting the slides 65 and 66 to move toward the front of the cart. As the upper frame is raised to the transport position, the compression spring 141 drives the forward slide forward to its transport position and the tension spring 155 pulls the rearward slide forward to its transport position. When both slides are in the transport position, the pins drop into engagement with the stops as has been described above.

The cart is then wheeled to a position adjacent the rear end of the ambulance. In this position, the person at the front end of the cart operates the lever 84 which pulls the pin 69 from the stop 103. This will permit the slide 66 to move in a forward direction even though the pin on the other side is still in a position to engage stop 94. The stop 94 does not prevent the slide 65 from moving in a forward direction. As the person raises the front end of the upper frame, the compression spring 141 urges the slide in a forward direction until the pin 69 passes the stop 101. When the pin is released, the engagement of it with the stop 101 will maintain the front end of the cart in the upwardly-inclined position bringing the entry wheels 34 at the level of the deck of the ambulance (FIGS. 8 and 8*a*). The pin on the other side of the slide can engage the stop 93 to prevent the slide from moving any farther in a forward direction. It might be observed that the stops 93 and 101 are spaced apart longitudinally by slightly over one inch in order to make sure that the opposed pins properly engage as they move from one position to another.

When the cart has thus been placed in the loading position, the person at the rear of the cart moves the entry wheels 34 onto the deck of the ambulance. He then lifts the rear end of the cart to about a level position and pulls the lever at the rear end of the cart and thrusts forward. At this point in the operation, it is desirable that the other person grasp the handle 24 on the lower frame 12 to assist in swinging the legs 13 and 14 rearwardly so that the man at the rear end of the cart does not have to overcome that resistance in thrusting the cart into the ambulance. As the cart is thrust into the ambulance, the rear edge of the ambulance engages the scuff pads 130, 131 at the forward part of the leg to help cam the legs into an upper position in which they lie against the underside of the frame 11 (FIGS. 9 and 9*a*).

As the cart is thrust into the ambulance, both legs swing in a rearward direction. In order to permit the front legs to swing in a rearward direction, the forward slide 65 must move in a forward direction. As it does so, it compresses the spring 145. At the rear of the cart the slide 66 slides rearwardly about two inches in order to permit the rear legs to pivot. When the cart is in the ambulance with the legs swung to the rear of the cart, the cart is in the "in-car" position. It is also possible to bring the cart to the "in-car" position outside of the ambulance simply by raising the rear end of the cart so that the weight in on the auxiliary wheels and forward wheels. When the rear lever 77 is actuated, the legs will be released in order to permit the upper frame to swing all the way to the ground. In this attitude, a patient, on the ground, can easily be shifted onto the cart.

At the hospital, the cart must be unloaded from the ambulance. One person at the rear of the cart starts to withdraw the cart from the ambulance. Without requiring the use of any levers, the legs will swing down to the loading position. In swinging down to the loading position, the compression spring 145 will drive the slide 65 at the forward end of the cart in a rearward direction until the pin 69 hits the stop 101 which maintains the cart in the upwardly-inclined loading position. The pin 69 on the opposite side of the slide 65 will pass over the stop 93 so that the two opposed pins will hold the forward slide 65 in the loading position.

After the cart is out of the ambulance, the operator at the forward end of the cart operates the lever 84 to withdraw the pin from the stop 101 and pushes down on the forward end of the cart. This force causes the slide 65 to move rearwardly. The pin projecting out of the tube 67 will engage the stop 94, thus blocking further rearward movement of the slide. At this point, the opposite pin can drop into the slot 103, thereby holding the cart in the transport position.

From the foregoing, it can be seen that the cooperative action of the slides, the pins and stops and the pivotal mounting of the legs with respect to the slides permits the cart to be shifted easily among the four positions, namely, the transport, the loading position, the "in-car" position and the intermediate position. In all of these positions, the wheels on the lower frame are well centered below the upper frame so that there is no weight imbalance that would tend to cause the cart to topple.

What is claimed is:

1. A multi-level ambulance cart comprising, an upper frame forming a bed, a lower frame, wheels supported on said lower frame, forward and rearward vertical legs connecting said upper frame to said lower frame with said lower frame approximately centered below said upper frame, means pivotally mounting said legs to said lower frame, means pivotally and slidably mounting said legs to said upper frame, means for locking the upper ends of said legs selectively in a transport position in the center portion of said cart and in home bed position toward the rear of said cart, and means maintaining said lower frame approximately centered below said upper frame as said slidable mounting means are shifted between said two positions.

2. A cart as in claim 1 further comprising, entry wheels mounted at the forward end of said upper frame, means permitting said legs and lower frame to swing rearwardly to lie against said upper frame as said entry wheels are resting on the deck of an ambulance, thereby permitting said cart to be thrust into the ambulance by a person grasping the rear of the cart.

3. A cart as in claim 1 further comprising, entry wheels mounted at the forward end of said upper frame, means permitting the forward end of said upper frame to be pivoted upwardly about said rear legs to an upwardly-inclined position for entry into a high deck ambulance, means bracing said upper frame in said upwardly-inclined position, and means permitting said legs and said lower frame to swing rearwardly to lie against said upper frame as said entry wheels are resting on the deck of an ambulance, thereby permitting said cart to be thrust into the ambulance by a person grasping the rear of the cart.

4. A multi-level ambulance cart comprising, an upper frame forming a bed, a lower rigid frame, wheels supported on said lower frame, forward and rearward vertical legs connecting said upper frame to said lower frame with said lower frame approximately centered below said upper frame, a longitudinal beam supported on said upper frame, a front slide slidably mounted on said beam and pivotally connected to the upper end of said front legs, a rear slide slidably mounted on said beam and pivotally connected to the upper end of said rear legs, means releasably locking said slides in selected longitudinal positions on said beam to adjust the positions of said upper frame with respect to said lower frame.

5. A cart as in claim 4 further comprising, an operator lever at each end of said upper frame for selectively operating said releasable means.

6. A cart as in claim 4 further comprising, locking pins slidably mounted in said slides, springs urging said pins toward said beam, stops on said beam engageable by said pins to position the upper ends of said legs in selected positions, a longitudinal release bar mounted by pivoted arms to said beam on each side of said beam, said bars being movable laterally when pulled longitudinally, said bars being engageable with said pins to withdraw said pins from said stops, and an operator lever at each end of said cart to move a respective bar longitudinally.

7. A cart as in claim 6 in which both said slides have pins engageable by one release bar, said forward slide having a pin engageable by the other of said release bars, said stops requiring both release bars to be operated simultaneously to release said slides for rearward movement to lower said upper frame to an intermediate position.

8. A cart as in claim 7 in which said stops engageable by a pin on said forward slide permit the forward slide to move forwardly to raise the forward end of said upper frame with respect to said lower frame and to brace said forward end in said raised position to enable said cart to be thrust into a high deck ambulance while said legs are pivoted rearwardly to lie against said upper frame.

9. A multi-level ambulance cart comprising, an upper frame forming a bed, entry wheels mounted on the forward end of said upper frame, a lower frame, wheels supported on said lower frame, forward and rearward legs connecting said upper frame to said lower frame, a longitudinal beam supported on said upper frame, forward and rearward slides slidably mounted on said beam, the upper ends of said legs being pivotally mounted on said slides, releasable abutment means on said beam and slides respectively to lock said slides in selected positions to permit said upper frame to assume the following positions with respect to said lower frame:

(a) transport position with rear legs vertical, front legs rearwardly-inclined and upper frame horizontal, (b) loading position with rear legs vertical, front slide moved forwardly, front legs vertical and upper frame upwardly-inclined, (c) intermediate position with front and rear slides positioned rearwardly to swing said legs forwardly to lower said upper frame to an intermediate position, (d) in-car position with said legs swung rearwardly to lie against said upper frame.

10. A cart as in claim 9 further comprising, a rod interconnecting the upper ends of said legs whereby as said cart is shifted from said transport position to said intermediate position, said forward slide is urged rearwardly to force said rear slide rearwardly and to swing said rear legs past a vertical position so that weight upon the cart will cause said rear legs to swing to their intermediate position.

11. A cart as in claim 9 further comprising, a spring connected between said upper frame and said forward slide to urge said forward slide to its forward loading position as the forward end of said upper frame is raised from its transport position to a loading position.

12. A cart as in claim 9 further comprising, a spring connected between said upper frame and said rear slide to urge said rear slide in a forward direction to its transport position as said upper frame is raised from its intermediate position to its transport position.

13. A cart as in claim 9 further comprising, a spring connected between said upper frame and said forward slide to urge said forward slide rearwardly to its loading position as said upper frame is moved from its in-car position to its transport position.

* * * * *